US010984712B2

(12) United States Patent
Brownlow et al.

(10) Patent No.: US 10,984,712 B2
(45) Date of Patent: Apr. 20, 2021

(54) TFT PIXEL CIRCUIT FOR OLED EXTERNAL COMPENSATION USING AN ADJUSTED DATA VOLTAGE FOR COMPONENT COMPENSATION

(71) Applicant: Sharp Kabushiki Kaisha, Osaka (JP)

(72) Inventors: Michael James Brownlow, Oxford (GB); Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/214,437

(22) Filed: Dec. 10, 2018

(65) Prior Publication Data

US 2020/0184888 A1 Jun. 11, 2020

(51) Int. Cl.

| | |
|---|---|
| ***G09G 3/30*** | (2006.01) |
| ***G09G 3/3233*** | (2016.01) |
| ***G09G 3/3275*** | (2016.01) |
| ***G09G 3/3266*** | (2016.01) |

(52) U.S. Cl.

CPC ..... *G09G 3/3233* (2013.01); *G09G 3/3266* (2013.01); *G09G 3/3275* (2013.01); *G09G 2330/021* (2013.01)

(58) Field of Classification Search

CPC ..... G09G 3/30–3291; G09G 3/12; G06F 3/12–14

See application file for complete search history.

(56) References Cited

U.S. PATENT DOCUMENTS 6,433,488 B1 8/2002 Bu
7,414,599 B2 8/2008 Chung et al.
7,876,292 B2 1/2011 Cho et al.
9,336,717 B2 5/2016 Chaji
9,997,106 B2 6/2018 Chaji
(Continued)

*Primary Examiner* — Sanghyuk Park
(74) *Attorney, Agent, or Firm* — Renner, Otto, Boisselle & Sklar, LLP

(57) ABSTRACT

A display system includes a pixel circuit and an external compensation system that is operable with the pixel circuit to compensate for differences in a property of the drive transistor and/or light-emitting device. The pixel circuit includes a drive transistor configured to control an amount of current to a light-emitting device; a second transistor having a first terminal connected to the gate of the drive transistor and a second terminal connected to a data voltage input that is supplied by the external compensation system, and a gate of the second transistor is connected to a first control signal; a third transistor having a first terminal connected to a second terminal of the drive transistor and a second terminal connected to a second voltage supply input that is supplied from the external compensation system, wherein a current flow from the second voltage supply input is measured by the external compensation system, and wherein a gate of the third transistor is connected to a second control signal; and a fourth transistor having a first terminal connected to the second terminal of the drive transistor and a second terminal connected to a third voltage supply input, wherein a gate of the fourth transistor is connected to a third control signal. The external voltage compensation system is configured to adjust the data voltage input based on the measured current flow to compensate for a variation in a property of the drive transistor and/or the light-emitting device.

17 Claims, 12 Drawing Sheets

(56) References Cited

U.S. PATENT DOCUMENTS

| | | | | |
|---|---|---|---|---|
| 2009/0079679 | A1* | 3/2009 | Nam | G09G 3/3233 345/82 |
| 2014/0225883 | A1* | 8/2014 | Chaji | G09G 3/3233 345/212 |
| 2014/0340436 | A1* | 11/2014 | Kumeta | G09G 3/3291 345/691 |
| 2015/0379940 | A1* | 12/2015 | Kishi | G09G 3/3225 345/690 |
| 2016/0163261 | A1* | 6/2016 | Kim | G09G 3/3233 345/205 |
| 2018/0033366 | A1* | 2/2018 | Yoo | G09G 3/3233 |
| 2018/0308425 | A1* | 10/2018 | Zhou | G09G 3/3233 |
| 2019/0251909 | A1* | 8/2019 | Talebzadeh | G09G 3/3233 |

* cited by examiner

TFT PIXEL CIRCUIT FOR OLED EXTERNAL COMPENSATION USING AN ADJUSTED DATA VOLTAGE FOR COMPONENT COMPENSATION

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a drive transistor. In one example, an input signal, such as a high "SCAN" signal, is employed to switch transistors in the circuit to permit a data voltage, VDAT, to be stored at a storage capacitor during a programming phase. When the SCAN signal is low and a switch transistor isolates the circuits from the data voltage, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{OLED} - V_{TH})^2$$

where $V_{OLED}$ is the voltage at anode of the OLED.

TFT device characteristics, especially the TFT threshold voltage $V_{TH}$, may vary, for example due to manufacturing processes and/or stress and aging of the TFT device during the operation. With the same VDAT voltage, the amount of current delivered by the TFT drive transistor could vary by a large amount due to such threshold voltage variations. Therefore, pixels in a display may not exhibit uniform brightness for a given VDAT value. In addition, OLED device characteristics may vary due to manufacturing processes, and/or stress and aging during the operation of the OLED. For example, the threshold voltage of the OLED for light emission may change. Conventional circuit configurations, therefore, often include elements that operate to compensate for at least some of these component variations to achieve an OLED display with more uniform brightness among sub-pixels.

Accordingly, there are various methods that have been employed to compensate for the drive TFT and OLED variations. Normally, such methods use a circuit configuration having several transistors. The size required by many of these circuit configurations may not be suitable for high resolution displays having high pixels per inch (ppi), in which each subpixel occupies only a small area. With a small area and limited number of transistors, external measurement and compensation may be used to measure the circuit performance and device properties, such as threshold voltage and mobility of the drive transistor and the OLED. An external circuit, therefore, may be used to generate a compensated data signal according to those measurements for appropriate compensation.

One approach for external compensation is described in U.S. Pat. No. 6,433,488 (Bu, issued Aug. 13, 2002). During measurements, the current to the OLED is diverted to an external current comparator and compared with a reference current. An output data voltage is used to adjust the current through the drive transistor. This approach is deficient, however, because the current is diverted from the OLED, and thus the OLED properties are not measured. The drive transistor may not work in the same condition as in the emission phase, and thus the compensation measurements may not be accurate.

Another approach for external compensation is described in U.S. Pat. No. 7,876,292 (Cho et al., issued Jan. 25, 2011). During the measurement stage, the current through the OLED is sensed and compared with a reference current and then the difference is converted to a data voltage. This data voltage is then applied to the gate of the drive transistor. This approach also is deficient because the anode and cathode of the OLED have to connect to the pixel circuit. During the manufacturing process, normally only one of the nodes, the anode or cathode, is accessible from the pixel circuit, and thus compensation during use may not be sufficiently accurate.

Another approach for external compensation is described in U.S. Pat. No. 9,336,717 (Chaji, issued May 10, 2016).). A monitor line is used to monitor the current through the drive transistor while the OLED is turned off. The programming data voltage is adjusted according to the monitored current. This approach is deficient because the pixel circuits have five transistors, and thus the number of transistors is undesirably high in the external compensation scheme.

Another approach for external compensation is described in U.S. Pat. No. 9,997,106 (Chaji, issued Jun. 12, 2018). A monitor line is used to monitor the current through the drive transistor while the OLED is turned off. The programming data voltage is adjusted according to the monitored current. In the pixel circuits, the storage capacitor is connected between the source and gate of the drive transistor. This approach is deficient because the parasitic capacitance of the OLED could affect the charge distribution between the storage capacitor and the parasitic capacitors. The OLED mismatch could cause more variations in light emission than other methods.

It is desirable that the measurement time for the pixel circuitry be as short as possible for optimal performance of the display system. A significant challenge with respect to conventional external compensation systems is minimizing the measurement time.

SUMMARY OF INVENTION

The present invention relates to pixel circuits that can be used in combination with an external compensation system. During a test current measurement phase, the current that flows through the drive transistor and the OLED is sensed through a duplicate voltage supply line. The duplicate voltage supply line is configured to have the same voltage as the pixel circuit voltage supply line. The pixel circuits have only four transistors and one capacitor, which fits into a small area that is suitable for high-resolution display applications. The architecture of the pixel circuits is suitable for both analogue and digital external compensation systems.

In exemplary embodiments, a sensed current through the duplicate voltage supply line is fed into an analogue external compensation system, in which the current is compared with a programming reference current. The difference between the sensed current and the reference current is converted to an adjusted data voltage, which controls the current through the OLED during the emission phase. The updated or adjusted data voltage provides for adequate compensation of drive transistor and OLED characteristics, and the updated data voltage becomes stable when the difference between the measured sensed current and the reference current is smaller than the system resolution.

In other exemplary embodiments, the sensed current through the duplicate voltage supply line is fed into a digital external compensation system, in which the applied data voltage and the measured current can be compared with a predefined data voltage and a corresponding current database. A compensated data voltage is then obtained to provide adequate compensation of drive transistor and OLED characteristics. The compensated data voltage is applied to the pixel circuit, and based on the compensation algorithm, the variations of drive transistor properties and/or the variations of the OLED are compensated.

An aspect of the invention, therefore, is a display system comprising a pixel circuit and an external compensation system that is operable with the pixel circuit to compensate for differences in a property of the drive transistor and/or light-emitting device. In exemplary embodiments, the pixel circuit includes: a drive transistor configured to control an amount of current to a light-emitting device depending upon a voltage applied to a gate of the drive transistor; wherein the light-emitting device is connected at a first node to a first terminal of the drive transistor and at a second node to a first voltage supply input; a second transistor having a first terminal connected to the gate of the drive transistor and a second terminal connected to a data voltage input that is supplied by the external compensation system, and a gate of the second transistor is connected to a first control signal; a third transistor having a first terminal connected to a second terminal of the drive transistor and a second terminal connected to a second voltage supply input that is supplied from the external compensation system, wherein a current flow from the second voltage supply input is measured by the external compensation system, and wherein a gate of the third transistor is connected to a second control signal; and a fourth transistor having a first terminal connected to the second terminal of the drive transistor and a second terminal connected to a third voltage supply input, wherein a gate of the fourth transistor is connected to a third control signal. The external voltage compensation system is configured to adjust the data voltage input based on the measured current flow to compensate for a variation in a property of the drive transistor and/or the light-emitting device.

In exemplary embodiments, the external compensation system is an analogue external compensation system including a current mirror that mirrors the current flow from the second voltage supply input and outputs the mirrored current; and an integrator that receives the output of the mirrored current and receives a programming reference current, wherein the integrator outputs the adjusted data voltage based on a comparison between the mirrored current and the programming reference current. In such embodiments, a method of operating the display system comprises the steps of: during a current sensing and data programming phase: disconnecting the drive transistor from the third voltage supply input and connecting the drive transistor to the second voltage supply input; measuring a current through the third transistor using the analogue external compensation system; comparing the measured current with a programming reference current, wherein a difference between the measured current and reference current is converted to an adjusted data voltage; and outputting the adjusted data voltage to the pixel circuit; and during an emission phase: disconnecting the drive transistor from the second voltage supply input and connecting the drive transistor to the third voltage supply input, wherein the adjusted data voltage is applied to the gate of the drive transistor to control the current through the light-emitting device.

In other exemplary embodiments, the external compensation system is a digital external compensation system including a current measurement device that measures the current flow from the second voltage supply input; a memory device that stores said measured current flow; a compensation calculator that obtains the measured current flow from the memory device and receives an image data input, and a data voltage generation unit that generates a compensated data voltage and outputs the compensated data voltage to the pixel circuit. In such embodiments, the method of operating the pixel circuit comprises the steps of: during a measurement data programming phase of a current measurement stage: disconnecting the drive transistor from the third voltage supply input, and applying a data voltage to the gate of the drive transistor; during a test measurement phase of the current measurement stage, connecting the drive transistor to the second voltage supply input, measuring the current from the second voltage supply input and storing the measured current in a memory device; and disconnecting the drive transistor from the second voltage supply input; and during a data programming phase of a normal operation stage, executing the compensation algorithm to generate the compensated data voltage by comparing programming image data and the measured current data from the memory device based on a predefined data voltage as related to a corresponding current database stored as part of the compensation algorithm;applying the compensated data voltage to the gate of the drive transistor; and during an emission phase of the normal operation stage, connecting the drive transistor to the third voltage supply input, wherein the compensated data voltage applied to the gate of the drive transistor controls the current through the light-emitting device. The current measurement stage is performed in a frame once every N frames of performing the normal operation stage, wherein N>1 and preferably N is in a range of 1800 to 18000 for a 60 Hz refresh rate.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
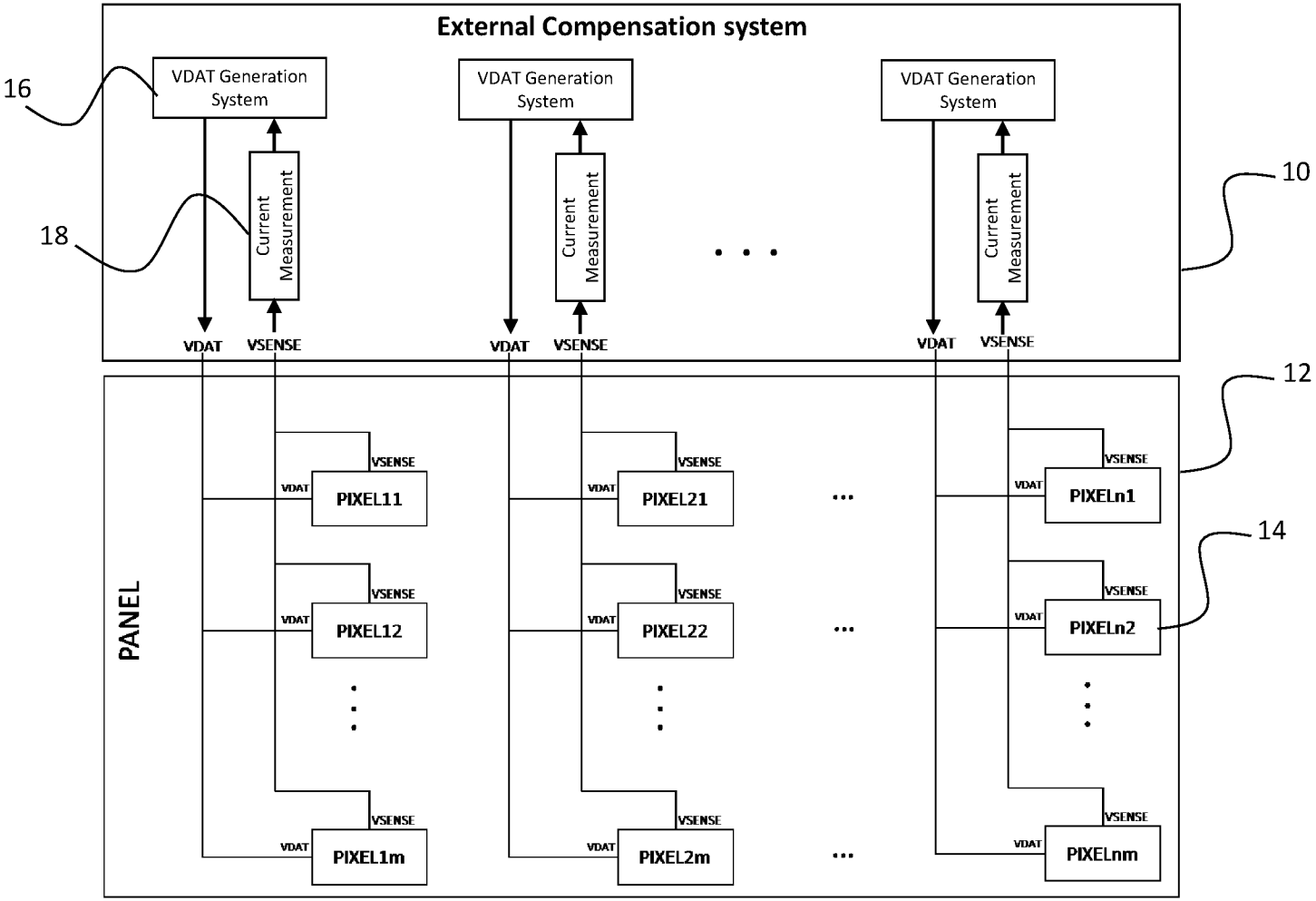
FIG. 1 is a drawing depicting an exemplary display system including an external compensation system with a display panel including a pixel array of pixels arranged in "n" columns by "m" rows.

Embodiments of the present invention will now be described with reference to the drawings, wherein like reference numerals are used to refer to like elements throughout. It will be understood that the figures are not necessarily to scale.

FIG. 1 is a drawing depicting a display system including an external compensation system 10 with a display panel 12 including a pixel array of pixels 14 arranged in "n" columns by "m" rows. As further detailed below, control signals applied to the rows enable each row, one row at a time from a first row to the last row, to be programmed to generate one image frame. A data voltage VDAT is applied from a VDAT generation system 16 in the column during a scan period for each row. The data voltage in the column will change to corresponding image data for the next row. Also during the scan period, each pixel has a sense line through which a current flows through a duplicate supply voltage line VSENSE to the OLED in the pixel, and the current that flows through the VSENSE line is measured or sensed in the external compensation system 10 using a current measurement device 18. The pixels in one column share one sense line, and thus when there are n columns in the display panel 12, there will be n sense lines. The current in each pixel 14 only is sensed when the corresponding row is selected. For each sense line, there is only one pixel sensed at any time as selected by application of the appropriate control signal. Details and various embodiments of this overall system configuration are described with respect to the subsequent figures below.

Figure 2:
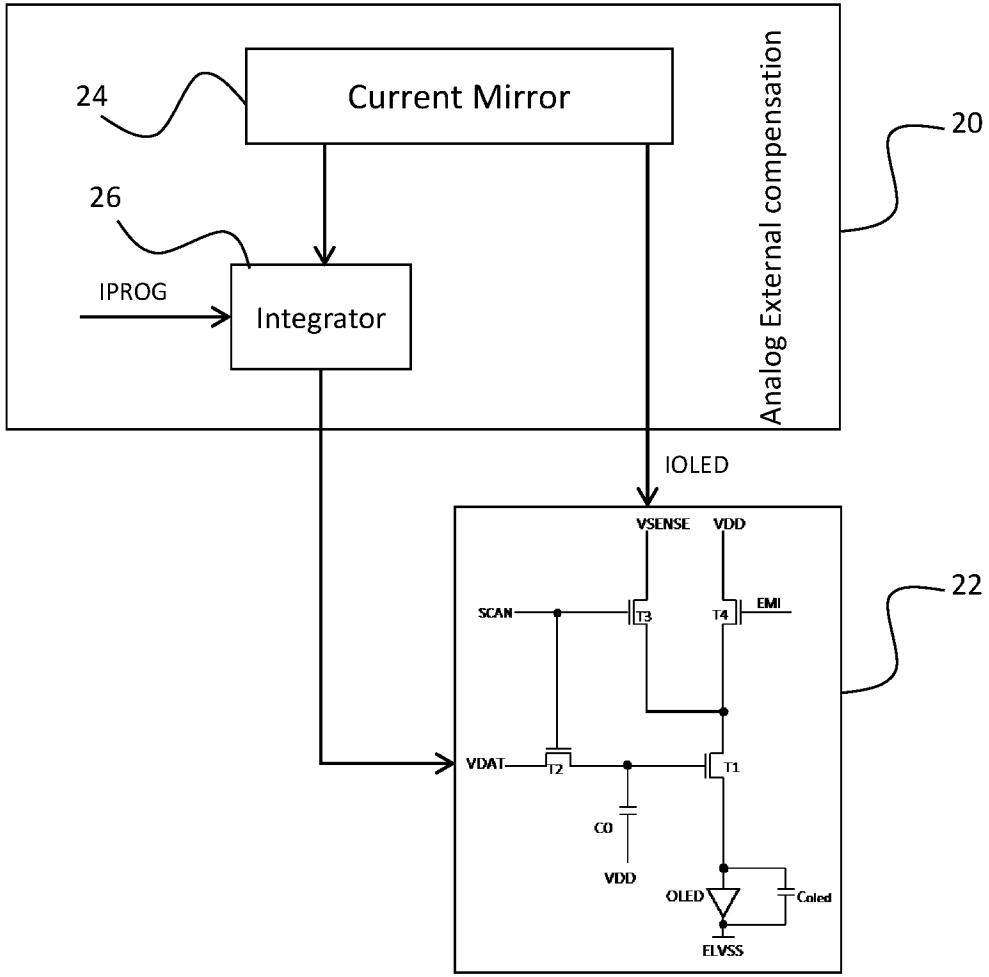
FIG. 2 is a drawing depicting an exemplary display system including an analogue external compensation system in combination with a pixel circuit in accordance with embodiments of the present invention.

FIG. 2 is a drawing depicting a display system including an exemplary analogue external compensation system 20 in combination with a pixel circuit 22 in accordance with embodiments of the present invention. Current flows through a duplicate supply line at the terminal VSENSE in the pixel 22 to the OLED, the current through the VSENSE line being denoted $I_{OLED}$. This current to the OLED is sensed in the analogue external compensation system 20 using a current mirror 24, and any suitable current mirror 24 as is known in the art may be used. The sensed current is mirrored by the current mirror 24 to the internal circuits in the compensation system, and the mirrored current is compared with a programming reference current, $I_{PROG}$. In particular, the mirrored current and the programming reference current are inputted into an integrator 26, which calculates a difference between the mirrored current and the reference current and converts the current difference to an adjusted data voltage VDAT. The adjusted data voltage is applied to the gate of a drive transistor T1 in the pixel 22 by operation that is described in detail below. In general, the drive transistor controls the current to the OLED, $I_{OLED}$. When the current difference between the sensed OLED current and the programming reference current is smaller than the system resolution, the data voltage becomes stable. In this manner, the programming reference current is programmed to the pixel circuits by application of the adjusted data voltage VDAT to the drive transistor T1.

Figure 3:
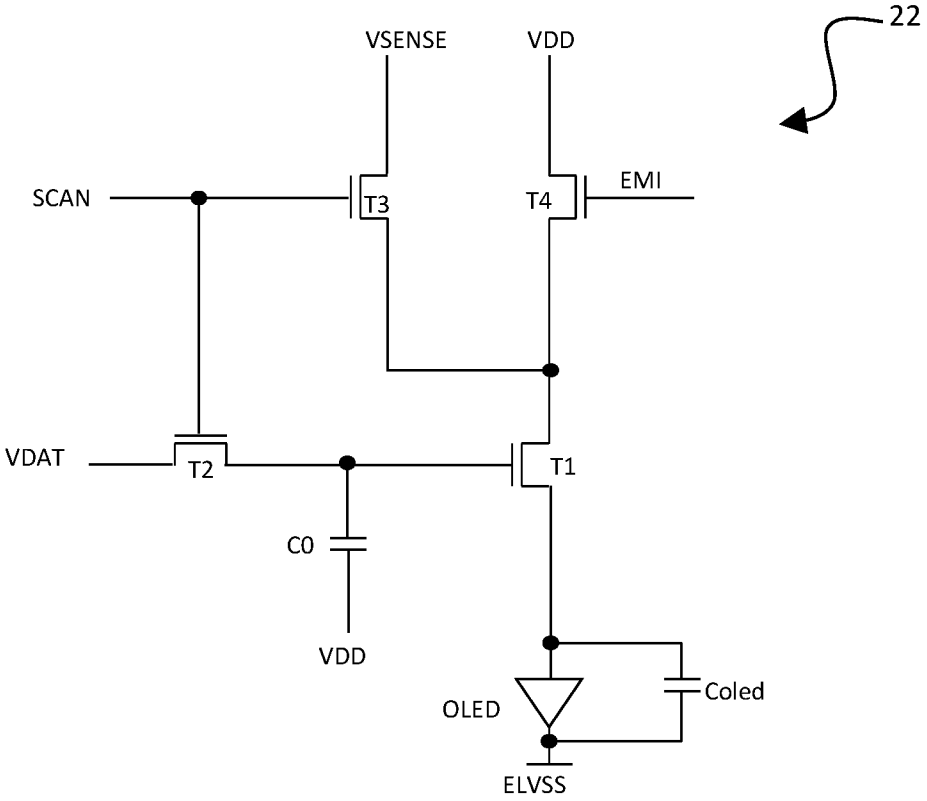
FIG. 3 is a drawing depicting a first pixel circuit configuration as shown in FIG. 2 in accordance with embodiments of the present invention.
Figure 4:
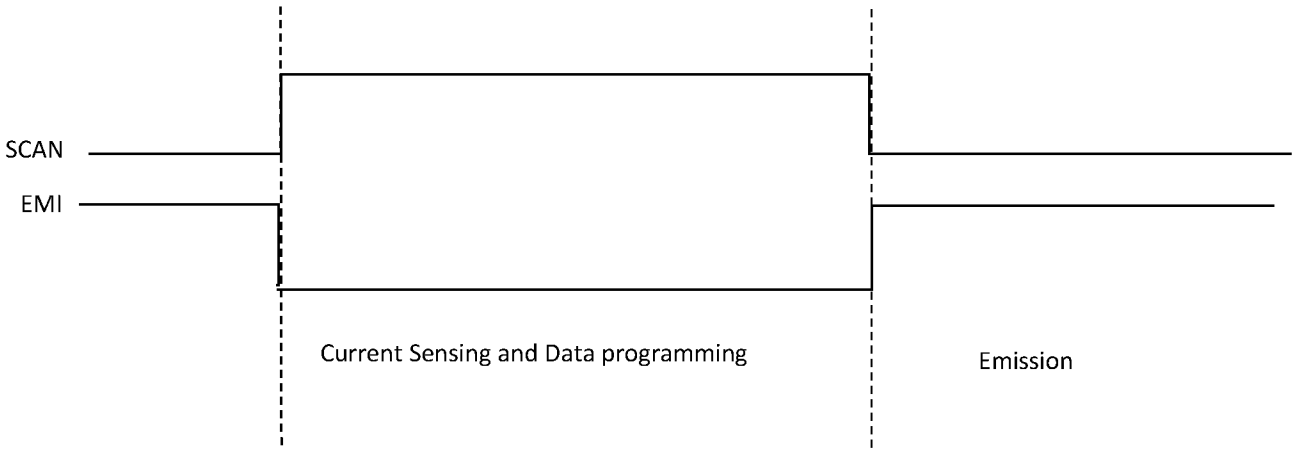
FIG. 4 is a drawing depicting a timing diagram illustrating the operation of the pixel circuit of FIG. 3.

To illustrate more detailed operation, FIG. 3 is a drawing depicting a first pixel circuit configuration 22 as shown in FIG. 2 in accordance with embodiments of the present invention. FIG. 4 is a drawing depicting a timing diagram illustrating the operation of the pixel circuit 22 of FIG. 3. In this example, the pixel circuit 22 is configured as a thin film transistor (TFT) circuit that includes multiple n-type transistors T1-T4 and one capacitor $C_0$. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 3 depicts the TFT pixel circuit 22 configured with multiple n-MOS or n-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first power supply ELVSS as is conventional.

The OLED and the TFT circuit 22, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 22 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitor may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T1 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to first power supply ELVSS in this example. The injection layers, transport layers and emission layer may be organic materials, the first and second electrodes may be metals, and all of these layers may be deposited by a thermal evaporation technique.

Referring to the TFT pixel circuit 22 of FIG. 3 in combination with the timing diagram of FIG. 4, the pixel circuit 22 operates to perform in two phases: (1) a current sensing and data programming phase, and (2) an emission phase for light emission. In this first embodiment, during the previous emission phase, a control signal EMI signal level has a high voltage value, so transistor T4 is in an on state to apply the emission current from the voltage supply line VDD through the drive transistor to the OLED. A control signal SCAN signal level has a low voltage value so transistors T2, T3 are in an off state.

At the beginning of the current sensing and data programming phase, the EMI signal level is changed from the high voltage value to the low voltage value, causing transistor T4 to be turned off. With transistor T4 turning off, the power supply, VDD, is disconnected from the pixel circuit.

Then, the SCAN signal level is changed from the low voltage value to the high voltage value, causing transistors T3 and T2 to be turned on. With transistor T3 turning on, the pixel is connected to the duplicate power supply VSENSE as supplied by the analogue external compensation system of FIG. 2. With transistor T2 turning on, the data voltage, VDAT, is connected to the gate of the drive transistor through T2 and to the storage capacitor, $C_0$. With applying VDAT at the gate of the drive transistor, a current may flow from the duplicate power supply VSENSE through transistor T3 and through the drive transistor T1 to the OLED. As the pixel drive transistor is an n-type TFT, the current through OLED in first order is $$I_{OLED}=\beta(V_{DAT}-V_{OLED}-V_{TH})^2$$

where $V_{OLED}$ is the voltage at anode of the OLED.

The voltage between the drain and source of the drive transistor T1, $V_{ds}$, is only a second order, and thus a difference of $V_{ds}$ causes only a small current variation. Accordingly, even when there are small differences between VDD and VSENSE, the OLED current $I_{OLED}$ could be still similar with such difference when VDD is connected to the pixel, such that $V_{ds}=V_{DD}-V_{OLED}$. The current mirror for current sensing is connected to the VSENSE terminal of the pixel, such that $V_{ds}=V_{SENSE}-V_{OLED}$. Accordingly, when measuring the current flow through the duplicate power supply VSENSE, the sensed current should be similar to the current flow to the OLED during emission when the pixel is connected to the power supply VDD. Because of such current similarity, the current sensing may be used to compensate for any variations of the drive transistor and OLED properties.

In particular, the current that flows through the duplicate power supply VSENSE is sensed in the analogue external compensation system 20 of FIG. 2 using the current mirror 24. The sensed current is then mirrored by the current mirror 24, and this mirrored current is inputted to the integrator 26 of the analogue external compensation system. The mirrored current of the current mirror 24 is compared with a programming reference current $I_{prog}$ that also is inputted to the integrator 26. The difference between the mirrored and programming reference currents is integrated by the integrator 26 and converted to an adjusted data voltage, VDAT. This VDAT voltage is applied through the on-state transistor T2 to the gate of the drive transistor T1. The current through the drive transistor of the pixel circuit thus is changed according to the change of the adjusted VDAT voltage level. When the difference between the sensed current and the programming reference current is below the system resolution, the VDAT voltage becomes a stable voltage level.

In essence, therefore, during the current sense and data programming phase, a test current is applied through the VSENSE line to the OLED. The test current is mirrored and applied to the integrator for comparison to the programming reference current. The test current could be the current from the previous frame or initialized by a test data voltage, VDAT. As the currents are similar and optimally should be the same, the difference of the two currents is used to adjust the VDAT voltage applied to the drive transistor of the pixel circuit to an optimal level. The adjusted and optimized VDAT is then used in the emission phase for light emission.

At the end of the current sense and the data programming phase, the SCAN signal level is changed from the high voltage value to the low voltage value, causing transistors T2 and T3 to be turned off. With transistor T2 turning off, the VDAT input is disconnected from the gate of drive transistor T1, and the voltage VDAT is stored at the top plate of the storage capacitor $C_0$ for the emission phase. The bottom plate of the capacitor $C_0$ is connected to a power supply, such as reusing the pixel power supply, VDD, for reducing the number of supplies in the pixel. Such power supply alternatively can be another independent power supply, such as VREF. As described above, the VDAT voltage is the optimized voltage for the drive transistor to output the defined programming reference current. With transistor T3 turning off, the pixel is disconnected from the duplicate power supply VSENSE.

At the beginning of the emission phase, the EMI signal level is changed from the low voltage value to the high voltage value, causing transistor T4 to be turned on. With T4 turning on, the pixel is connected to the power supply VDD, and current will flow from VDD through the drive transistor T1 and to the OLED. The current flowing through the pixel is approximate to the programming reference current based on the operation during the current sensing and data programming phase. Accordingly, any threshold or mobility variations of the drive transistor and OLED are compensated and do not affect the programmed current in the pixel.

Figure 5:
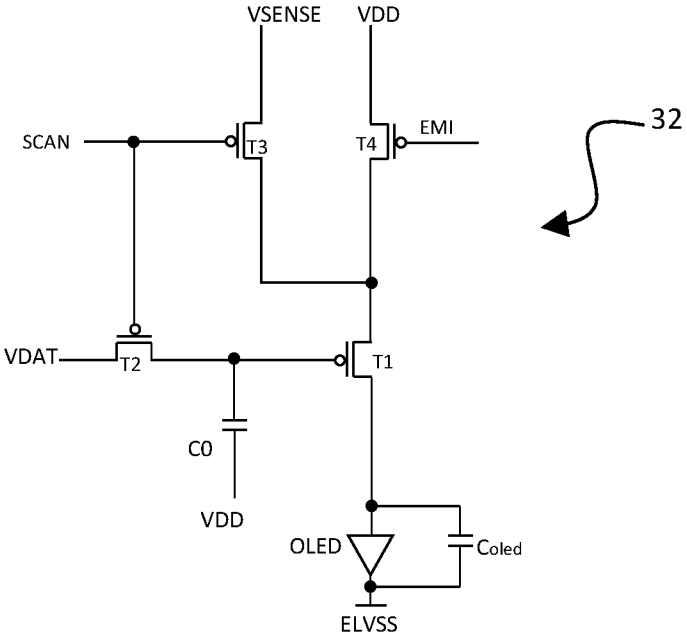
FIG. 5 is a drawing depicting a second pixel circuit configuration that may be used with the analogue external compensation system of FIG. 2 in accordance with embodiments of the present invention.
Figure 6:
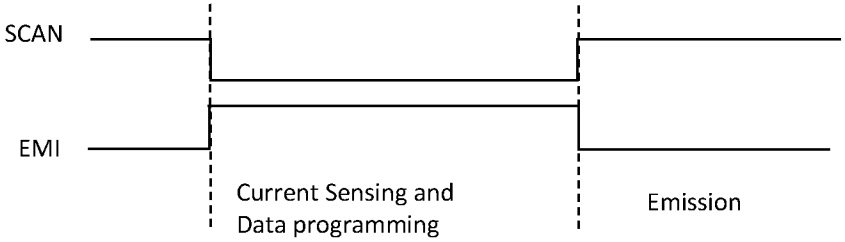
FIG. 6 is a drawing depicting a timing diagram illustrating the operation of the circuit of FIG. 5.

FIG. 5 is a drawing depicting a second pixel circuit configuration 32 that may be used with the analogue external compensation system 20 of FIG. 2 in accordance with embodiments of the present invention. FIG. 6 is a drawing depicting a timing diagram illustrating the operation of the circuit of FIG. 5. The circuit configuration 32 of FIG. 5 operates comparably as the circuit configuration 22 of FIG. 3, except that the circuit configuration 32 employs p-type transistors rather than n-type transistors. As is known in the art, the drive properties of an OLED may be more suitable for one or other of p-type versus n-type transistors, and the principles of the present invention are applicable to either type of configuration. Accordingly, in this example, the circuit 32 is configured as a TFT circuit that includes multiple p-type transistors T1-T4 and one capacitor $C_0$. The circuit elements drive a light-emitting device, such as for example an OLED. Similarly as in the first embodiment, this embodiment is described principally in connection with an OLED as the light-emitting device, and comparable principles may be used with display technologies that employ other types of light-emitting devices, including for example micro LEDs and quantum dot LEDs.

More specifically, FIG. 5 depicts the TFT pixel circuit 32 configured with multiple p-MOS or p-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first power supply ELVSS as is conventional.

Referring to the TFT circuit 32 of FIG. 5 in combination with the timing diagram of FIG. 6, the pixel circuit 32 operates to perform in two phases: (1) a current sense and data programming phase, and (2) an emission phase for light emission. In this exemplary embodiment, during the previous emission phase, the EMI signal level has a low voltage value, so transistor T4 is an on state for light emission by applying the emission current from the voltage supply VDD through the drive transistor T1 to the OLED. The SCAN signal level has a high voltage value so transistors T2 and T3 are in an off state.

At the beginning of the current sensing and data programming phase, the EMI signal level is changed from a low voltage value to a high voltage value, causing transistor T4 to be turned off. With transistor T4 turning off, the power supply VDD is disconnected from the pixel circuit. The SCAN signal level is changed from a high voltage value to a low voltage value, causing transistors T3 and T2 to be turned on. With transistor T3 turning on, the pixel circuit is connected to the duplicate power supply VSENSE. With transistor T2 turning on, the data voltage, VDAT, is connected to the gate of the drive transistor and the storage capacitor, $C_0$. With applying VDAT through transistor T2 to the gate of the drive transistor T1, a current may flow from the duplicate power supply VSENSE through the drive transistor T1 to the OLED. As the pixel drive transistor T1 is p-type TFT, the current through the OLED in first order is $$I_{OLED}=\beta(V_{DAT}-V_{DD}-V_{TH})^2 \text{ if VDD is connected}$$

$$I_{OLED}=\beta(V_{DAT}-V_{SENSE}-V_{TH})^2 \text{ if VSENSE is connected}$$

When the applied VDAT voltage is the same and the VSENSE voltage level is the same as the VDD voltage level, the current that flows from the voltage supply VSENSE should be the exactly same as the current flow from the supply VDD. Accordingly, similarly as in the previous embodiment, when measuring the current flow through the duplicate power supply VSENSE, the sensed current should be similar to the current flow to the OLED during emission when the pixel is connected to the power supply VDD.

The current that flows through the duplicated power supply VSENSE is sensed in the analogue external compensation system 20 by the current mirror 24. The sensed current is then mirrored by the current mirror 24 and inputted to the integrator 26 of the analogue external compensation system. The mirrored current is then compared by the integrator with a programming reference current, $I_{prog}$, that also is inputted to the integrator 26. The difference between the mirrored and programming reference currents is integrated by the integrator 26 and converted to an adjusted data voltage, VDAT. This VDAT voltage is applied through the on-state transistor T2 to the gate of the drive transistor T1. The current through the drive transistor of the pixel circuit thus is changed according to the change of the adjusted VDATA voltage level. When the difference between the sensed current and the programming reference current is below the system resolution, the VDAT voltage becomes a stable voltage level.

In essence, therefore, during the current sensing and data programming phase, similarly as in the previous embodiment, a test current is applied through the VSENSE line to the OLED. The test current is mirrored and applied to the integrator for comparison to the programming reference current. As the currents are similar and optimally should be the same, the difference of the two currents is used to adjust the VDAT voltage applied to the drive transistor of the pixel circuit to an optimal level. The adjusted and optimized VDAT is then used in the emission phase for light emission.

At the end of the current sense and the data programming phase, the SCAN signal level is changed from the low voltage value to the high voltage value, causing transistor T2 and T3 to be turned off. With transistor T2 turning off, the VDAT is disconnected from the gate of drive transistor, and the adjusted voltage VDAT is stored at the top plate of the storage capacitor $C_0$ for the emission phase. The bottom plate of the capacitor $C_0$ is connected to the power supply VDD. As described above, the adjusted VDAT voltage is the optimized voltage for the drive transistor to output the defined programming reference current. With transistor T3 turning off, the pixel is disconnected from the duplicate power supply line VSENSE.

At the beginning of the emission phase, the EMI signal level is changed from the high voltage value to the low voltage value, causing transistor T4 to be turned on. With T4 turning on, the pixel is connected to the power supply VDD, and current will flow from VDD through the drive transistor T1 and to the OLED. The current flowing through the pixel is approximate to the programming reference current based on the operation during the current sense and data programming phase. Accordingly, any threshold or mobility variations of the drive transistor and OLED are compensated and do not affect the programmed current in the pixel.

In the previous embodiments, an analogue external compensation system is employed to compensate for variations in drive transistor and OLED characteristics. Alternative embodiments employ a digital external compensation system.

Figure 7:
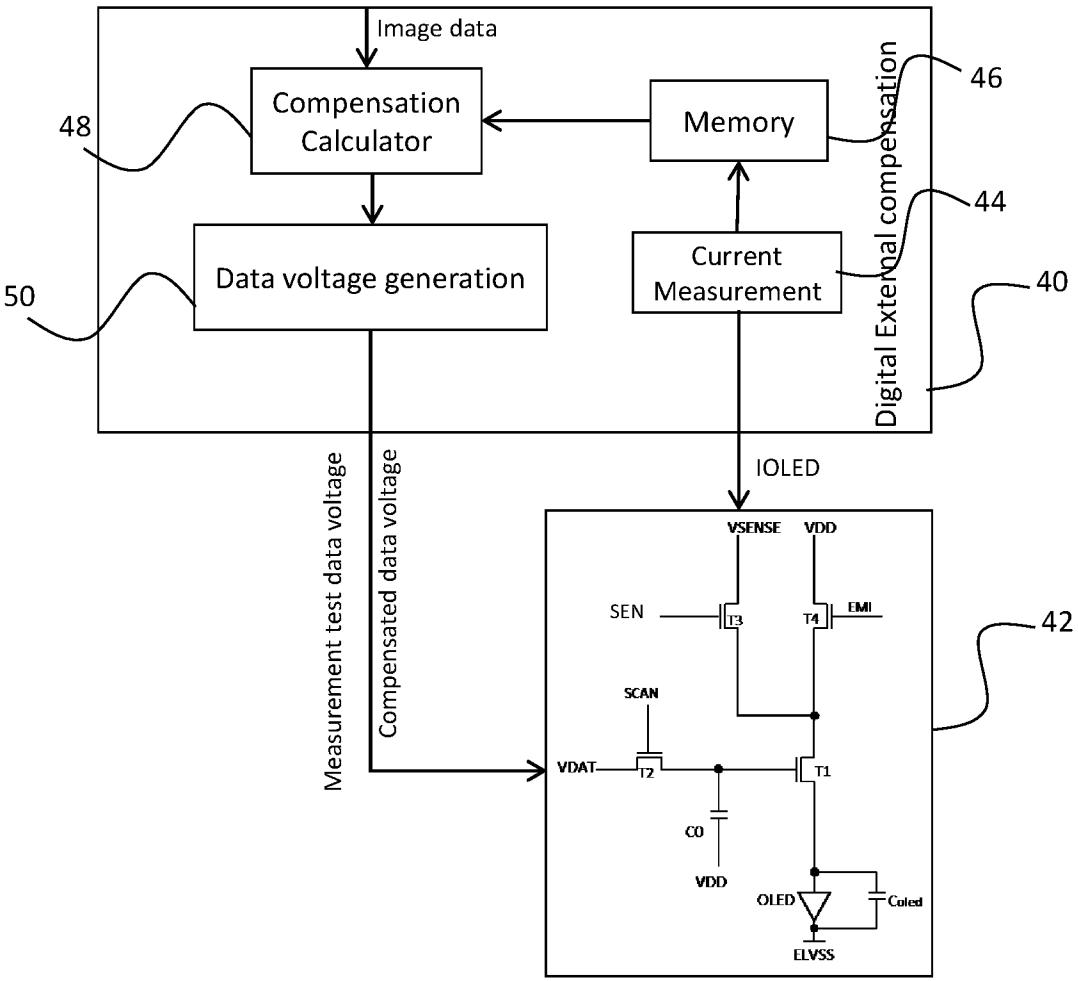
FIG. 7 is a drawing depicting an exemplary display system including a digital external compensation system in combination with a pixel circuit in accordance with embodiments of the present invention.

FIG. 7 is a drawing depicting a display system including an exemplary digital external compensation system 40 in combination with a third pixel circuit 42 in accordance with embodiments of the present invention. As further detailed below, the digital external compensation system 40 operates in two stages including (1) a current measurement stage, and (2) a normal operation stage. The current measurement stage is divided into sub-stages, including (1a) a measurement data programming phase, and (1b) a test measurement phase. The normal operation stage also is divided into two sub-stages, including (2a) a data programming phase, and (2b) an emission phase.

Generally, during the current measurement stage, a measurement test data voltage is applied to the pixel circuit 42. The current flowing through a duplicate power supply VSENSE to the OLED, $I_{OLED}$, in the pixel circuit is measured by a current measurement device 44 in the digital external compensation system 40. The current measuring device may be any suitable current measurement device, including, for example a current input analogue-to-digital converter, ADC. The measured current is stored in a memory unit 46 of the digital external compensation system 40. The memory unit 46 may be any suitable non-transitory computer readable medium as are known in the art, such as a RAM element, flash memory device, or like device. Each pixel in the device array is measured one to several times, the number of iterations being selected depending on a predetermined compensation algorithm executed by a compensation calculator 48 to perform a sufficient number of test measurements as may be suitable for any particular application.

The compensation calculator 48 may be configured as an electronic processing device that executes the predetermined compensation algorithm, which may be embodied as computer code that is stored in a memory device that may be any suitable non-transitory computer readable medium, and may be the memory unit 46 or a separate memory device. The amount of memory storage dedicated for the current measurements may be equal to the number of measurements times the total number of pixels in the display panel array. The stored measurement values as generated in accordance with the compensation algorithm 48 are then used by a data voltage generation unit 50, which generates a compensated data voltage output that is inputted as VDAT to the pixel circuit 42. The data voltage generation unit may be any suitable current measurement device, including, for example a voltage digital-to-analogue converter, DAC. The compensated data voltage compensates the data voltage for use in the normal operation stage that includes light emission.

More particularly, during the normal operation stage, image data is input to the compensation calculator 48 of the digital external compensation system 40. The image data and the inputted measurement data from the memory unit 46 are processed by the compensation calculator 48 executing the compensation algorithm to generate a compensated data voltage VDAT. The compensated data voltage VDAT is then generated by the data voltage generation unit 50 and inputted through the transistor T2 and programmed to the gate of the drive transistor T1 in the pixel circuit 42 at the storage capacitor $C_0$.

Figure 8:
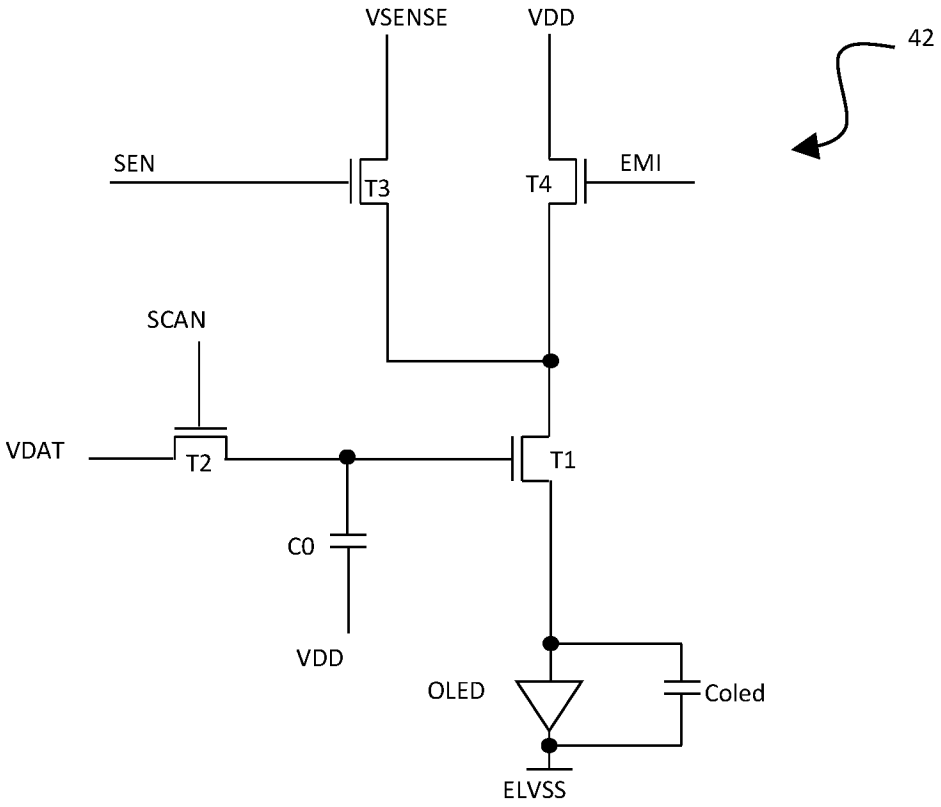
FIG. 8 is a drawing depicting a third circuit configuration as shown in FIG. 7 in accordance with embodiments of the present invention.
Figure 9:
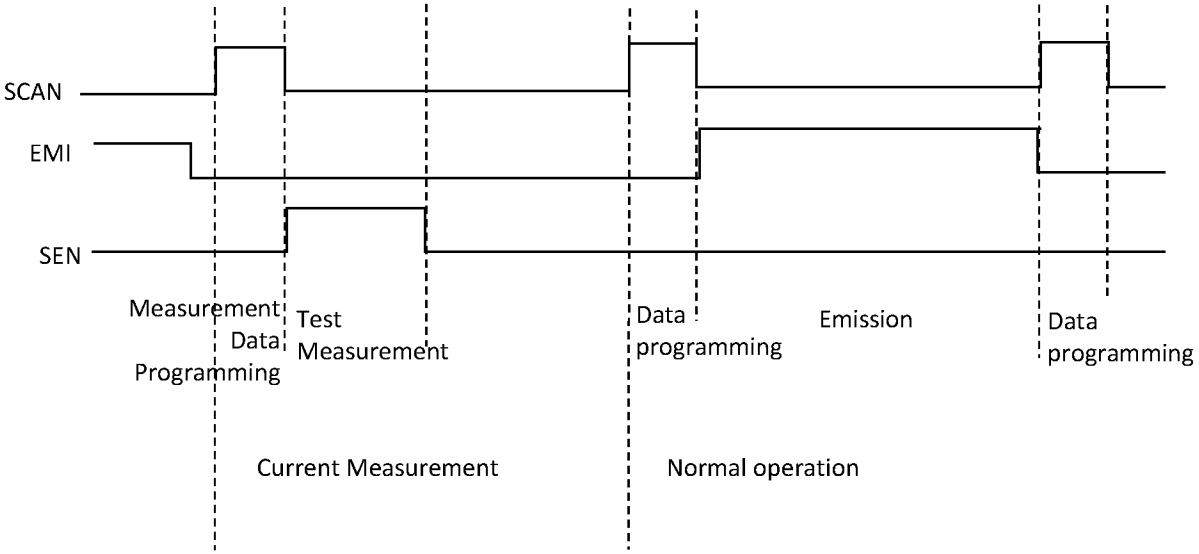
FIG. 9 is a drawing depicting a timing diagram illustrating the operation of the circuit of FIG. 8.

FIG. 8 is a drawing depicting the third circuit configuration 42 shown in FIG. 7 that may be used with the digital external compensation system 40 of FIG. 7 in accordance with embodiments of the present invention. FIG. 9 is a drawing depicting a timing diagram illustrating the operation of the circuit of FIG. 8. In this example, similarly to previous embodiments, the pixel circuit 42 is configured as a TFT circuit that includes multiple n-type transistors T1-T4 and one capacitor $C_0$. The circuit elements drive a light-emitting device, such as for example an OLED. Similarly as in the previous embodiments, this embodiment is described principally in connection with an OLED as the light-emitting device, and comparable principles may be used with display technologies that employ other types of light-emitting devices, including for example micro LEDs and quantum dot LEDs.

More specifically, FIG. 8 depicts the TFT circuit 42 configured with multiple n-MOS or n-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first power supply ELVSS as is conventional.

Referring to the TFT pixel circuit 42 of FIG. 8 in combination with the timing diagram of FIG. 9, the TFT pixel circuit 42 operates to perform in two stages: a current measurement stage and a normal operation stage. As referenced above, the current measurement stage is divided into sub-stages, including a measurement data programming phase and a test measurement phase as seen in FIG. 9. During the previous emission phase, the EMI signal level has a high voltage value, so transistor T4 is in an on state for light emission. The SCAN signal level has a low voltage value so transistor T2 is an off state. For embodiments employing the digital external compensation system 40, a third control signal SEN is applicable to transistor T3, and during the previous emission phase the SEN signal level also has a low voltage value so transistor T3 also is in an off state.

At the beginning of the measurement data programming phase of the current measurement stage, the EMI signal level is changed from a high voltage value to a low voltage value, causing transistor T4 to be turned off. With transistor T4 turning off, the power supply VDD is disconnected from the pixel circuit 42 and there is no light emission. Then, the SCAN signal level is changed from a low voltage value to a high voltage value, causing transistor T2 to be turned on. With transistor T2 turning on, the data voltage, VDAT, is connected to the gate of the drive transistor T1 through transistor T2 and stored at the storage capacitor $C_0$, and thus a measurement test data voltage (see FIG. 7) is applied to the gate of the drive transistor. At the end of the measurement data programming phase, the SCAN signal level is changed from the high voltage value to the low voltage value, causing transistor T2 to be turned off. With transistor T2 turning off, the VDAT is disconnected from the gate of drive transistor, and the measurement test data voltage VDAT is stored at the top plate of the storage capacitor $C_0$ for the next measurement phase. The bottom plate of the storage capacitor $C_0$ is connected to VDD.

At the beginning of the test measurement phase of the current measurement stage, the SEN signal level is changed from the low voltage value to the high voltage value, causing transistor T3 to be turned on. Accordingly, in embodiments incorporating the digital external compensation system, T3 is operated independently of T2 using the additional control signal SEN. With T3 turning on, the drive transistor is connected to the duplicate power supply VSENSE. The current $I_{oled}$ will flow from VSENSE through the drive transistor T1 via T3 and to the OLED based on the measurement test data voltage stored at the capacitor. In addition, the current is measured by the current measurement device 44 of the digital external compensation system 40, and the current measurement is stored in the memory unit 46. At the end of the test measurement phase, the SEN signal level is changed from the high voltage value to the low voltage value, causing transistor T3 to be turned off.

With T3 turning off, the pixel circuit 42 is disconnected from the duplicate voltage supply line VSENSE. As the EMI signal is still low, there is no current to the OLED, and the current measurement stage proceeds to apply test measurements for the next pixels in turn in the device array until the test measurement phase is complete for the pixels in the device array. The test measurement time is normally set to a few hundred microseconds to a few milliseconds, which is a fraction of the light emission time. The test measurement time also depends on the current through the OLED during test measurement, and any light emission during the test measurement should be insufficient to be noticeable with human eyes. With the completion of the test measurements, the current measurement stage is complete.

After the current measurement stage, the compensation calculator 48 executing the compensation algorithm compares programming image data and the measured current data from the memory unit 46 based on a predefined data voltage as related to a corresponding current database stored as part of the compensation algorithm (see FIG. 7). In this manner, a compensated data voltage can be determined. The compensated data voltage is generated by the data voltage generation unit 50 as a result of the determination of the compensation calculator 48 executing the compensation algorithm, and such compensated data voltage is applied to the pixel circuit 42 as an input to transistor T2 as shown in FIG. 7. Based on the compensation algorithm, the variations of drive transistor properties and/or the variations of the OLED properties are compensated.

Once the compensated data voltage is determined, the pixel circuit 42 can operate in the normal operation stage. As referenced above, the normal operation stage also is divided into two sub-stages, including a data programming phase and an emission phase as seen in FIG. 9. At the beginning of the data programming phase, the EMI signal level is held at the low voltage value if immediately after the current measurement stage, or changed from the low voltage value to the high voltage value if during the subsequent normal operation stage, causing transistor T4 to be in the off state. With transistor T4 remaining off, the power supply still is disconnected from the pixel circuit 42. Then, the SCAN signal level is changed from the low voltage value to the high voltage value, causing transistor T2 to be turned on. With transistor T2 turning on, the compensated data voltage, VDAT, is connected through transistor T2 to the gate of the drive transistor T1 and the storage capacitor $C_0$. At the end of the data programming phase, the SCAN signal level is changed from the high voltage value to the low voltage value, causing transistor T2 to be turned off. With transistor T2 turning off, the compensated VDAT is disconnected from the gate of drive transistor, and the compensated VDAT is stored at the top plate of the storage capacitor $C_0$ for the emission phase. The bottom plate of the capacitor $C_0$ is connected to the power supply VDD as referenced above.

At the beginning of the emission phase, the EMI signal level is changed from the low voltage value to the high voltage value, causing transistor T4 to be turned on. With T4 turning on, the drive transistor is connected to the power supply VDD via T4, and current will flow from VDD through the drive transistor T1 and to the OLED. Accordingly, the current to the OLED has been compensated according to the previously measured current data and the generation of the compensated data voltage, VDAT. Based on the compensation algorithm, the variations of drive transistor properties and/or the variations of the OLED properties are compensated.

Figure 10:
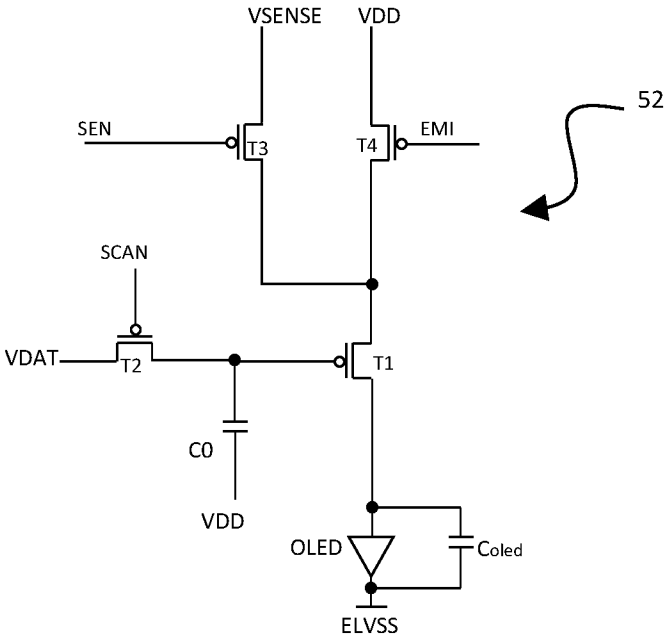
FIG. 10 is a drawing depicting a fourth circuit configuration that may be used with the digital external compensation system of FIG. 7 in accordance with embodiments of the present invention.
Figure 11:
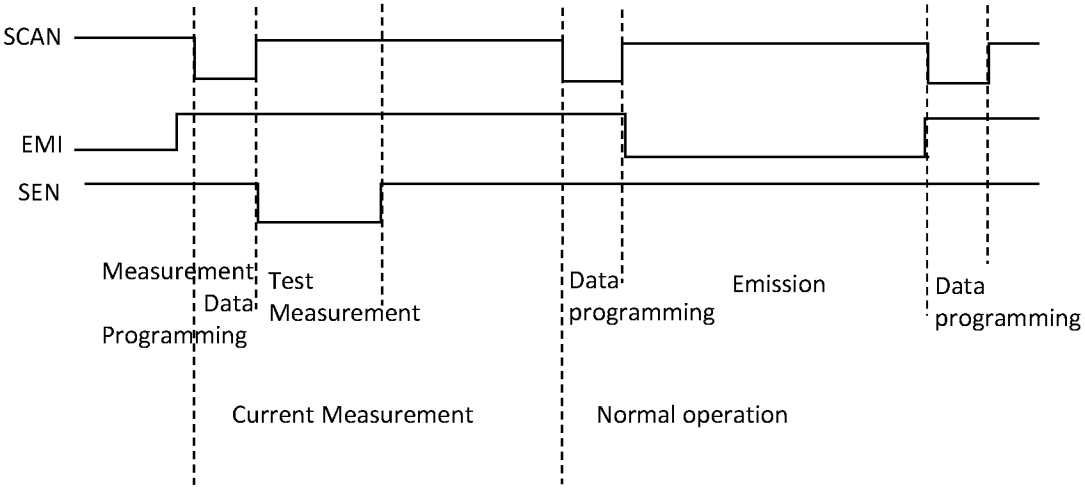
FIG. 11 is a drawing depicting a timing diagram illustrating the operation of the circuit of FIG. 10.

FIG. 10 is a drawing depicting a fourth pixel circuit configuration 52 that may be used with the digital external compensation system 40 of FIG. 7 in accordance with embodiments of the present invention. FIG. 11 is a drawing depicting a timing diagram illustrating the operation of the circuit of FIG. 10. The circuit configuration 52 of FIG. 10 operates comparably as the circuit configuration 42 of FIG. 8, except that the circuit configuration 52 employs p-type transistors rather than n-type transistors. As is known in the art, the drive properties of an OLED may be more suitable for one or other of p-type versus n-type transistors, and the principles of the present invention are applicable to either type of configuration. Accordingly, in this example, the circuit 52 is configured as a TFT circuit that includes multiple p-type transistors T1-T4 and one capacitor $C_0$. The circuit elements drive a light-emitting device, such as for example an OLED. Similarly as in the previous embodiments, this embodiment is described principally in connection with an OLED as the light-emitting device, and comparable principles may be used with display technologies that employ other types of light-emitting devices, including for example micro LEDs and quantum dot LEDs.

Moe specifically, FIG. 10 depicts the TFT pixel circuit 52 configured with multiple p-MOS or p-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first power supply ELVSS as is conventional.

Referring to the TFT pixel circuit 52 of FIG. 10 in combination with the timing diagram of FIG. 11, the TFT pixel circuit 52 operates to perform in two stages: a current measurement stage and a normal operation stage. As referenced above, the current measurement stage is divided into sub-stages, including a measurement data programming phase and a test measurement phase as seen in FIG. 11. During the previous emission phase, the EMI signal level has a low voltage value, so transistor T4 is in an on state for light emission. The SCAN signal level has a high voltage value so transistor T2 is in an off state. Again, for embodiments employing the digital external compensation system 40, a third control signal SEN is applicable to transistor T3, and during the previous emission phase the SEN signal level has a high voltage value so transistor T3 also is in an off state.

At the beginning of the measurement data programming phase of the current measurement stage, the EMI signal level is changed from a low voltage value to a high voltage value, causing transistor T4 to be turned off. With transistor T4 turning off, the power supply VDD is disconnected from the pixel circuit 52 and there is no light emission. Then, the SCAN signal level is changed from a high voltage value to a low voltage value, causing transistor T2 to be turned on. With transistor T2 turning on, the data voltage, VDAT, is connected to the gate of the drive transistor T1 through transistor T2 and stored at the storage capacitor $C_0$, and thus a measurement test data voltage (see FIG. 7) is applied to the gate of the drive transistor. At the end of the measurement data programming phase, the SCAN signal level is changed from the low voltage value to the high voltage value, causing transistor T2 to be turned off. With transistor T2 turning off, the VDAT is disconnected from the gate of drive transistor, and the measurement test data voltage VDAT is stored at the top plate of the storage capacitor $C_0$ for the next test measurement phase. The bottom plate of the storage capacitor $C_0$ is connected to VDD as referenced above.

At the beginning of the test measurement phase of the current measurement stage, the SEN signal level is changed from the high voltage value to the low voltage value, causing transistor T3 to be turned on. Accordingly, as in the previous embodiment incorporating the digital external compensation system, T3 is operated independently of T2 using the additional control signal SEN. With T3 turning on, the drive transistor T1 is connected to the duplicate power supply, VSENSE. The current $I_{oled}$ will flow from VSENSE through the drive transistor T1 via T3 and to the OLED. In addition, the current is measured by the current measurement device 44 of the digital external compensation system 40, and the current measurement is stored in the memory unit 46. At the end of the test measurement phase, the SEN signal level is changed from the low voltage value to the high voltage value, causing transistor T3 to be turned off.

With T3 turning off, the pixel circuit 52 is disconnected from the duplicate voltage supply line VSENSE. As the EMI signal is still high, there is no current to the OLED, and the current measurement stage proceeds to apply test measurements to the next pixels in turn in the device array until the test measurement phase is complete for the pixels in the array. As referenced above, the test measurement time is normally set to a few hundred microseconds to a few milliseconds, which is a fraction of the light emission time. The test measurement time also depends on the current through the OLED during test measurement, and any light emission during the test measurement should be insufficient to be noticeable with human eyes. With the completion of the test measurements for the pixels in the device array, the current measurement stage is complete.

After the current measurement stage, comparably as in the previous embodiment, compensation calculator 48 uses the compensation algorithm to compare programming image data and the measured current data from the memory unit 46 based on a predefined data voltage as related to a corresponding current database stored as part of the compensation algorithm 48. In this manner, a compensated data voltage can be determined. The compensated data voltage is generated by the date voltage generation unit 50 as a result of the determination of the compensation algorithm 48, and such compensated data voltage is applied as VDAT to the pixel circuit 52 as an input to transistor T2 as shown in FIG. 7. Based on the compensation algorithm, the variations of drive transistor properties and/or the variations of the OLED properties are compensated.

Once the compensated data voltage is determined, the pixel circuit 52 can operate in the normal operation stage. As referenced above, the normal operation stage also is divided into two sub-stages, including a data programming phase and an emission phase as seen in FIG. 11. At the beginning of the data programming phase, the EMI signal level is held at the high voltage value if immediately after the current measurement stage, or changed from the low voltage value to the high voltage value if during the subsequent normal operation stage, causing transistor T4 to be in the off state. With transistor T4 remaining off, the power supply VDD still is disconnected from the pixel circuit 52. Then, the SCAN signal level is changed from the high voltage value to the low voltage value, causing transistor T2 to be turned on. With transistor T2 turning on, the compensated data voltage, VDAT, is connected through transistor T2 to the gate of the drive transistor T1 and the storage capacitor $C_0$. At the end of the data programming phase, the SCAN signal level is changed from the low voltage value to the high voltage value, causing transistor T2 to be turned off. With transistor T2 turning off, the compensated VDAT is disconnected from the gate of drive transistor, and the compensated VDAT is stored at the top plate of the storage capacitor $C_0$ for the emission phase. The bottom plate of the capacitor $C_0$ is connected to the power supply VDD as referenced above.

At the beginning of the emission phase, the EMI signal level is changed from the high voltage value to the low voltage value, causing transistor T4 to be turned on. With T4 turning on, the drive transistor is connected to the power supply VDD via T4, and current will flow from VDD through the drive transistor T1 and to the OLED. Accordingly, the current to the OLED has been compensated according to the previously measured current data and the generation of the compensated data voltage, VDAT. Based on the compensation algorithm, the variations of drive transistor properties and/or the variations of the OLED properties are compensated. The emission phase continues until the next image frame, at which the next data programming phase is performed as shown in FIG. 11, and so for subsequent frames.

Figure 12:
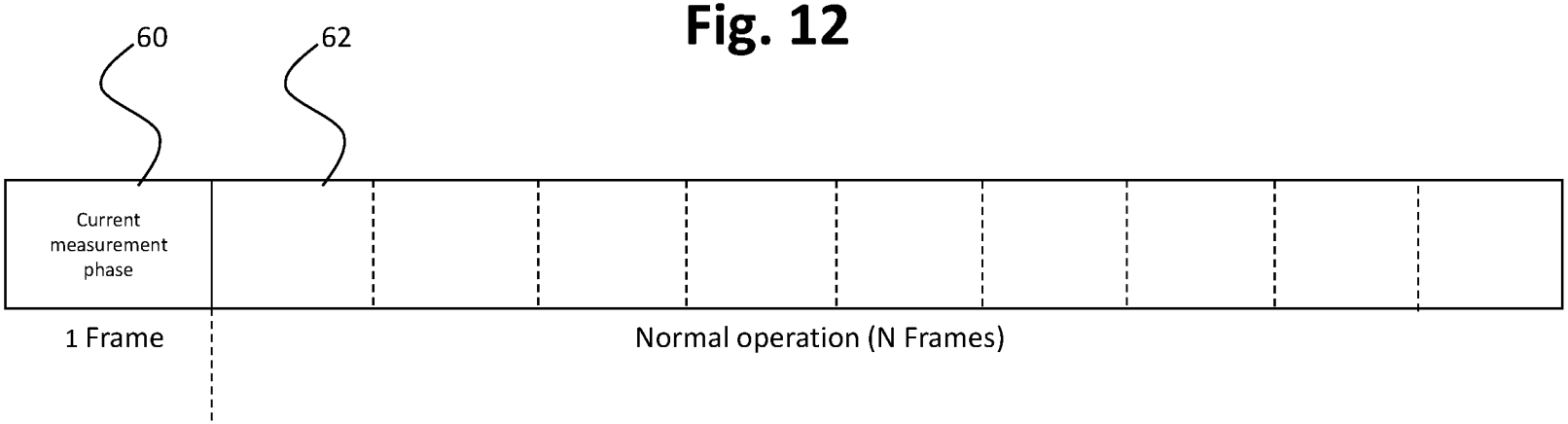
FIG. 12 is a drawing depicting a timing relating the current measurement stage and the normal operation stage for operation of the digital external compensation system of FIG. 7.

The digital external compensation system 40 takes advantage of the fact that the drive transistor and OLED characteristic do not change rapidly. Accordingly, the current measurement phase only needs to be performed once every "N" frames of the normal operation stages that include emission. In this regard, FIG. 12 is a drawing depicting an exemplary timing relating the current measurement stage and the normal operation stage for operation of the digital external compensation system of FIG. 7. As seen in FIG. 12, the current measurement stage is performed during a first frame 60 followed by subsequent "N" frames 62 of the normal operation stage in which no current measurement stage is performed, wherein N>1. In exemplary embodiments, N is substantially greater than one, and typically is on the order of hundreds or thousands of frames or more. As the drive transistor and OLED characteristics change slowly, the current measurement stage measurement can be performed such as every 30 to 300 seconds, and the corresponding "N" would be 1800 to 18000 for 60 Hz refresh rate.

As a comparison of the analogue external compensation system 20 and the digital external compensation system 40, the measurement control signals for the analogue system are different from the control signals for the digital system, with the digital system including the additional SEN control signal. For the analogue system, the transistors T2 and T3 are operated together with the common control signal SCAN, as such transistors need to be in the on state together to enable the continuous adjustment of VDAT with the current measurement until the difference between the measured current and programming reference current are smaller than the system tolerance.

In contrast, for the digital system the current measurement is normally taken when the voltage on the storage capacitor settles after transistor T2 turns off. In this manner, the timing sequence of the current measurement of the digital system is similar to normal operation. Any voltage disturbance caused by control signals changing from one level to another level and T2 switching is similar between the current measurement stage and the normal operation stage. With a similar VDAT voltage, the measured current is more similar to the actual current during emission than otherwise, and thus the digital compensation system tends to be more accurate than the analogue compensation system, but at the cost of the added control signal SEN that is not utilized in the analogue compensation system. The selection of analogue versus digital external compensation system, therefore, can be based on whether a particular application is more suitable for a more simple analogue system, versus a more accurate but slightly more complex digital system.

An aspect of the invention, therefore, is a display system comprising a pixel circuit and an external compensation system that is operable with the pixel circuit to compensate for differences in a property of the drive transistor and/or light-emitting device. In exemplary embodiments, the pixel circuit includes a drive transistor configured to control an amount of current to a light-emitting device depending upon a voltage applied to a gate of the drive transistor, wherein the light-emitting device is connected at a first node to a first terminal of the drive transistor and at a second node to a first voltage supply input; a second transistor having a first terminal connected to the gate of the drive transistor and a second terminal connected to a data voltage input that is supplied by the external compensation system, and a gate of the second transistor is connected to a first control signal; a third transistor having a first terminal connected to a second terminal of the drive transistor and a second terminal connected to a second voltage supply input that is supplied from the external compensation system, wherein a current flow from the second voltage supply input is measured by the external compensation system, and wherein a gate of the third transistor is connected to a second control signal; and a fourth transistor having a first terminal connected to the second terminal of the drive transistor and a second terminal connected to a third voltage supply input, wherein a gate of the fourth transistor is connected to a third control signal. The external voltage compensation system is configured to adjust the data voltage input based on the measured current flow to compensate for a variation in a property of the drive transistor and/or the light-emitting device. The display system may include one or more of the following features, either individually or in combination.

In an exemplary embodiment of the display system, the external compensation system is an analogue external compensation system.

In an exemplary embodiment of the display system, the first control signal is the same as the second control signal.

In an exemplary embodiment of the display system, the analogue external compensation system comprises: a current mirror that mirrors the current flow from the second voltage supply input and outputs the mirrored current; and an integrator that receives the output of the mirrored current and receives a programming reference current, wherein the integrator outputs the adjusted data voltage based on a comparison between the mirrored current and the programming reference current.

In an exemplary embodiment of the display system, the external compensation system is a digital external compensation system.

In an exemplary embodiment of the display system, the first control signal is different from the second control signal.

In an exemplary embodiment of the display system, the digital external compensation system comprises: a current measurement device that measures the current flow from the second voltage supply input; a memory device that stores said measured current flow; a compensation calculator that obtains the measured current flow from the memory device and receives an image data input, wherein the compensation calculator determines a compensated data voltage based on a comparison between the measured current flow and a reference current corresponding to the image data; and a data voltage generation unit that generates the compensated data voltage and outputs the compensated data voltage to the pixel circuit.

In an exemplary embodiment of the display system, the second voltage supply input and the third voltage supply input have the same voltage level.

In an exemplary embodiment of the display system, the second voltage supply input and the third voltage supply input have a voltage difference, and current flow to the light-emitting device is compensated to be the same when the pixel circuit is connected to the second voltage supply input or the third voltage supply input.

In an exemplary embodiment of the display system, the transistors are n-type transistors.

In an exemplary embodiment of the display system, the transistors are p-type transistors.

In an exemplary embodiment of the display system, the pixel circuit further comprises a storage capacitor connected to the gate of the drive transistor that stores the data voltage.

In an exemplary embodiment of the display system, the light-emitting device is one of an organic light-emitting diode, a micro light-emitting diode (LED), or a quantum dot LED.

Another aspect of the invention is a method of operating a display system comprising a pixel circuit according to any embodiments and an analogue external compensation system according to any of the embodiments. In exemplary embodiments, the method of operating includes the steps of: during a current sensing and data programming phase: disconnecting the drive transistor from the third voltage supply input and connecting the drive transistor to the second voltage supply input; measuring a current through the third transistor using the analogue external compensation system; comparing the measured current with a programming reference current, wherein a difference between the measured current and reference current is converted to an adjusted data voltage; and outputting the adjusted data voltage to the pixel circuit; and during an emission phase: disconnecting the drive transistor from the second voltage supply input and connecting the drive transistor to the third voltage supply input, wherein the adjusted data voltage is applied to the gate of the drive transistor to control the current through the light emitting device. The method of operating may include one or more of the following features, either individually or in combination.

In an exemplary embodiment of the method of operating, the adjusted data voltage becomes stable when the measured current approaches the programming reference current.

In an exemplary embodiment of the method of operating, the method further includes storing the adjusted data voltage on a storage capacitor that is connected to the gate of the drive transistor.

Another aspect of the invention is a method of operating a display system comprising a pixel circuit accordingly to any embodiments and a digital external compensation system according to any of the embodiments that is operable with the pixel circuit. In exemplary embodiments, the method of operating includes the steps of: during a measurement data programming phase of a current measurement stage: disconnecting the drive transistor from the third voltage supply input, and applying a measurement test data voltage to the gate of the drive transistor; during a test measurement phase of the current measurement stage, connecting the drive transistor to the second voltage supply input, measuring the current from the second voltage supply input and storing the measured current in a memory device; comparing the stored measured current to input image data and generating a compensated data voltage based on the comparison; and disconnecting the drive transistor from the second voltage supply input; during a data programming phase of a normal operation stage, applying the compensated data voltage to the gate of the drive transistor; and during an emission phase of the normal operation stage, connecting the drive transistor to the third voltage supply input, wherein the compensated data voltage applied to the gate of the drive transistor controls the current through the light emitting device. The method of operating may include one or more of the following features, either individually or in combination.

In an exemplary embodiment of the method of operating, the method further includes, during the emission phase of the normal operation stage, storing the compensated data voltage on a storage capacitor that is connected to the gate of the drive transistor, and disconnecting the gate of the drive transistor from the compensated voltage data input.

In an exemplary embodiment of the method of operating, the current measurement stage is performed in a frame once every N frames of performing the normal operation stage, wherein N>1.

In an exemplary embodiment of the method of operating, N is in a range of 1800 to 18000 for a 60 Hz refresh rate.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10'external compensation system
12—display panel
14—pixels
16—VDAT generation system
18—current measurement device
20—exemplary analogue external compensation system
22—first pixel circuit
24—current mirror
26—integrator
32—second pixel circuit
40—exemplary digital external compensation system
42—third pixel circuit
44—current measurement device
46—memory unit
48—compensation calculator
50—data voltage generation unit
52—fourth pixel circuit
T1-T4—multiple transistors
OLED—organic light emitting diode (or generally light-emitting device)
$C_0$—storage capacitor
VDAT—data voltage
VDD—power supply
ELVSS—power supply
SCAN/EMI/SEN—control signals

What is claimed is:

1. A display system comprising a pixel circuit and an external compensation system that is operable with the pixel circuit;

the pixel circuit comprising:

a drive transistor configured to control an amount of current to a light-emitting device depending upon a voltage applied to a gate of the drive transistor, wherein the light-emitting device is connected at a first node to a first terminal of the drive transistor and at a second node to a first voltage supply input;

a second transistor having a first terminal connected to the gate of the drive transistor and a second terminal connected to a data voltage input that is supplied by the external compensation system, and a gate of the second transistor is connected to a first control signal;

a third transistor having a first terminal connected to a second terminal of the drive transistor and a second terminal connected to a second voltage supply input that is supplied from the external compensation system, wherein a current flow from the second voltage supply input is measured by the external compensation system, and wherein a gate of the third transistor is connected to a second control signal;

a fourth transistor having a first terminal connected to the second terminal of the drive transistor and a second terminal connected to a third voltage supply input, wherein a gate of the fourth transistor is connected to a third control signal; and a storage capacitor that stores the data voltage having a first terminal directly connected to the gate of the drive transistor and a second terminal directly connected to a power supply input, wherein the second terminal of the storage capacitor is connected only directly to the power supply input without a connection of the second terminal of the storage capacitor to any of the drive transistor and second through fourth transistors;

wherein the external voltage compensation system is configured to adjust the data voltage input based on the measured current flow to compensate for a variation in a property of the drive transistor and/or the light-emitting device;

wherein the second voltage supply input and the third voltage supply input have a voltage difference, and an amount of current flow to the light-emitting device is the same when the pixel circuit is connected to the second voltage supply input as when the pixel circuit is connected to the third voltage supply input.

2. The display system of claim 1, wherein the external compensation system is an analog external compensation system.

3. The display system of claim 2, wherein the first control signal is the same as the second control signal.

4. The display system of claim 2, wherein the analog external compensation system comprises:

a current mirror that mirrors the current flow from the second voltage supply input and outputs the mirrored current; and an integrator that receives the output of the mirrored current and receives a programming reference current, wherein the integrator outputs the adjusted data voltage based on a comparison between the mirrored current and the programming reference current and applies the adjusted data voltage directly to the pixel circuit.

5. The display system of claim 1, wherein the external compensation system is a digital external compensation system.

6. The display system of claim 5, wherein the first control signal is different from the second control signal.

7. The display system of claim 5, wherein the digital external compensation system comprises:

a current measurement device that measures the current flow from the second voltage supply input;

a memory device that stores said measured current flow;

a compensation calculator that obtains the measured current flow from the memory device and receives an image data input, wherein the compensation calculator determines a compensated data voltage based on a comparison between the measured current flow and a reference current corresponding to the image data; and a data voltage generation unit that generates the compensated data voltage and outputs the compensated data voltage to the pixel circuit.

8. The display system of claim 1, wherein the second voltage supply input and the third voltage supply input have the same voltage level.

9. The display system of claim 1, wherein the transistors are n-type transistors.

10. The display system of claim 1, wherein the transistors are p-type transistors.

11. The display system of claim 1, wherein the light-emitting device is one of an organic light-emitting diode, a micro light-emitting diode (LED), or a quantum dot LED.

12. A method of operating a display system comprising a pixel circuit and an analog external compensation system that is operable with the pixel circuit;

wherein the pixel circuit comprises:

a drive transistor configured to control an amount of current to a light-emitting device depending upon a voltage applied to a gate of the drive transistor; wherein the light-emitting device is connected at a first node to a first terminal of the drive transistor and at a second node to a first voltage supply input;

a second transistor having a first terminal connected to the gate of the drive transistor and a second terminal connected to a data voltage input that is supplied by the analog external compensation system, and a gate of the second transistor is connected to a first control signal;

a third transistor having a first terminal connected to a second terminal of the drive transistor and a second terminal connected to a second voltage supply input that is supplied from the analog external compensation system, wherein a current flow from the second voltage supply input is measured by the analog external compensation system, and wherein a gate of the third transistor connected to the first control signal; and a fourth transistor having a first terminal connected to the second terminal of the drive transistor and a second terminal connected to a third voltage supply input, wherein a gate of the fourth transistor is connected to a second control signal; and a storage capacitor that has a first terminal directly connected to the gate of the drive transistor and a second terminal directly connected to a power supply input, wherein the second terminal of the storage capacitor is connected only directly to the power supply input without a connection of the second terminal of the storage capacitor to any of the drive transistor and second through fourth transistors the method of operating comprising steps of:

during a current sensing and data programming phase: disconnecting the drive transistor from the third voltage supply input and connecting the drive transistor to the second voltage supply input; measuring a current through the third transistor using the analog external compensation system; comparing the measured current with a programming reference current, wherein a difference between the measured current and reference current is converted to an adjusted data voltage; and outputting the adjusted data voltage from the analog external compensation system directly to the pixel circuit; during an emission phase: disconnecting the drive transistor from the second voltage supply input and connecting the drive transistor to the third voltage supply input, wherein the adjusted data voltage is applied to the gate of the drive transistor to control the current through the light emitting device; and storing the adjusted data voltage on the storage capacitor;

wherein the second voltage supply input and the third voltage supply input have a voltage difference, and an amount of current flow to the light-emitting device is the same when the pixel circuit is connected to the second voltage supply input as when the pixel circuit is connected to the third voltage supply input.

13. The method of operating of claim 12, wherein the adjusted data voltage becomes stable when the measured current approaches the programming reference current.

14. A method of operating a display system comprising a pixel circuit and a digital external compensation system that is operable with the pixel circuit;

wherein the pixel circuit comprises:

a drive transistor configured to control an amount of current to a light-emitting device depending upon a voltage applied to a gate of the drive transistor; wherein the light-emitting device is connected at a first node to a first terminal of the drive transistor and at a second node to a first voltage supply input;

a second transistor having a first terminal connected to the gate of the drive transistor and a second terminal connected to a data voltage input that is supplied by the digital external compensation system, and a gate of the second transistor is connected to a first control signal;

a third transistor having a first terminal connected to a second terminal of the drive transistor and a second terminal connected to a second voltage supply input that is supplied from the digital external compensation system, wherein a current flow from the second voltage supply input is measured by the digital external compensation system, and wherein a gate of the third transistor connected to a second control signal different from the first control signal;

a fourth transistor having a first terminal connected to the second terminal of the drive transistor and a second terminal connected to a third voltage supply input, wherein a gate of the fourth transistor is connected to a third control signal;

a storage capacitor that stores the data voltage having a first terminal directly connected to the gate of the drive transistor and a second terminal directly connected to a power supply input, wherein the second terminal of the storage capacitor is connected only directly to the power supply input without a connection of the second terminal of the storage capacitor to any of the drive transistor and second through fourth transistors;

the method of operating comprising steps of:

during a measurement data programming phase of a current measurement stage: disconnecting the drive transistor from the third voltage supply input, and applying a measurement test data voltage to the gate of the drive transistor;

during a test measurement phase of the current measurement stage, connecting the drive transistor to the second voltage supply input, measuring the current from the second voltage supply input and storing the measured current in a memory device; and disconnecting the drive transistor from the second voltage supply input;

during a data programming phase of a normal operation stage, executing a compensation algorithm to generate a compensated data voltage by comparing programming image data and the measured current data from a memory device based on a predefined data voltage as related to a corresponding current database stored as part of the compensation algorithm; applying the compensated data voltage to the gate of the drive transistor; and during an emission phase of the normal operation stage, connecting the drive transistor to the third voltage supply input, wherein the compensated data voltage applied to the gate of the drive transistor controls the current through the light emitting device;

wherein the second voltage supply input and the third voltage supply input have a voltage difference, and an amount of current flow to the light-emitting device is the same when the pixel circuit is connected to the second voltage supply input as when the pixel circuit is connected to the third voltage supply input.

15. The method of operating of claim 14, further comprising, during the emission phase of the normal operation stage, storing the compensated data voltage on a storage capacitor that is connected to the gate of the drive transistor, and disconnecting the gate of the drive transistor from the compensated voltage data input.

16. The method of operating of claim 14, wherein the current measurement stage is performed in a frame once every N frames of performing the normal operation stage, wherein N>1.

17. The method of operating of claim 16, wherein N is in a range of 1800 to 18000 for a 60 Hz refresh rate.

* * * * *